US009085186B2

(12) United States Patent
Sato

(10) Patent No.: US 9,085,186 B2
(45) Date of Patent: Jul. 21, 2015

(54) LIQUID EJECTING APPARATUS

(71) Applicant: SEIKO EPSON CORPORATION, Tokyo (JP)

(72) Inventor: Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/218,565

(22) Filed: Mar. 18, 2014

(65) Prior Publication Data

US 2014/0292896 A1 Oct. 2, 2014

(30) Foreign Application Priority Data

Mar. 29, 2013 (JP) ..... 2013-071603

(51) Int. Cl.
*B41J 25/308* (2006.01)

(52) U.S. Cl.
CPC ..... *B41J 25/3088* (2013.01)

(58) Field of Classification Search
USPC ..... 347/20, 37–39
See application file for complete search history.

(56) References Cited

U.S. PATENT DOCUMENTS 6,450,710 B1 * 9/2002 Foster et al. ..... 400/58

FOREIGN PATENT DOCUMENTS

JP 2009-056623 3/2009

* cited by examiner

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus which includes a moving body provided with a liquid ejecting head which ejects liquid from nozzles; a guide frame which guides the moving body in a moving direction; an urging member which urges the guide frame toward a side opposite to gravity direction; and a base frame which is provided with a first support unit which supports the guide frame, in which the first support unit regulates a displacement of the guide frame in the antigravity direction due to the urging member using abutment, and the guide frame is supported by the base frame in a state in which the guide frame can be displaced toward a gravity direction side with a gap between the base frame and the guide frame.

10 Claims, 8 Drawing Sheets

LIQUID EJECTING APPARATUS

BACKGROUND

1. Technical Field

The present invention relates to a liquid ejecting apparatus including a moving body which is provided with a liquid ejecting head, and a guide frame which guides the moving body in a moving direction.

2. Related Art

In the related art, a liquid ejecting apparatus which includes a liquid ejecting head ejecting liquid from nozzles in a carriage as an example of a moving body which moves (reciprocates) in one direction by being guided by a guide frame, and prints an image by ejecting liquid to a medium such as a sheet, or the like, using the liquid ejecting head has been commercialized. In such a liquid ejecting apparatus, liquid is ejected by setting a gap with an optimal dimension between the medium and the liquid ejecting head in order to perform printing of a high quality image.

Meanwhile, in recent years, a liquid ejecting apparatus has been minimized, and a user is able to easily carry the liquid ejecting apparatus. When the liquid ejecting apparatus is vibrated, or drops at the time of carrying the apparatus, there is a case in which a gap between a medium and a liquid ejecting head fluctuates due to a deformation of a guide frame, or the like. For this reason, there is a concern that a quality of a printed image may be deteriorated.

Therefore, in order to suppress a fluctuation in the gap between the medium and the liquid ejecting head due to such a vibration or dropping, for example, a structure in which the deformation of the guide frame is suppressed by causing a part of a base of a carriage to come into contact with a robust member such as a transporting unit of the medium, or a support unit of the medium in liquid ejecting apparatus has been proposed (for example, refer to JP-A-2009-56623).

However, in a liquid ejecting apparatus having such a structure, an impulsive force which is applied to the carriage is large, though the guide frame is hardly deformed when being vibrated or dropped, since the carriage comes into contact with the robust member such as the transporting unit or the support unit. That is, large acceleration is applied to the liquid ejecting head which is provided in the carriage. As a result, a force is generated in liquid in nozzles of the liquid ejecting head due to the large acceleration, a meniscus is broken, and ink is ejected from the nozzles. For this reason, there is a concern that so-called slipping-out of nozzles may occur in the liquid ejecting head, and liquid may not be properly ejected from the nozzles at the time of printing.

In addition, such a fact is generally common in a liquid ejecting apparatus including at least a moving body (carriage) which includes a liquid ejecting head, and a guide frame which guides a movement of the moving body.

SUMMARY

An advantage of some aspects of the invention is to provide a liquid ejecting apparatus in which deformation of a guide frame which guides a moving body is suppressed, and slipping-out of nozzles which causes leaking of liquid from the nozzles of a liquid ejecting head is suppressed.

Hereinafter, means of the invention and operation effects thereof will be described.

According to an aspect of the invention, there is provided a liquid ejecting apparatus which includes a moving body provided with a liquid ejecting head which ejects liquid from nozzles; a guide frame which guides the moving body in a moving direction; an urging member which urges the guide frame toward a side opposite to gravity direction; and a base frame which is provided with a first support unit which supports the guide frame, in which the first support unit regulates a displacement of the guide frame in the antigravity direction due to the urging member using abutment, and the guide frame is supported by the base frame in a state in which the guide frame can be displaced toward a gravity direction side with a gap between the base frame and the guide frame.

According to the configuration, positioning of the guide frame is performed so as not to be displaced toward the side opposite to gravity direction using abutment at the time of a normal use such as printing, and on the other hand, the guide frame can be displaced toward the gravity direction side while resisting an urging force of an urging member due to a gap on the gravity direction side. Accordingly, an impulsive force (acceleration) in the gravity direction which is applied to the moving body, and is generated when the liquid ejecting apparatus is dropped is relieved using a displacement in the gravity direction of the guide frame which guides the moving body, and it is possible to suppress a deformation of the guide frame, and to suppress so-called slipping-out of nozzles in which liquid is leaked from the nozzles of the liquid ejecting head.

In the liquid ejecting apparatus, the guide frame may be supported in an oscillating manner with respect to the base frame by setting the moving direction of the moving body to an axis line direction in the first support unit.

According to the configuration, even when a direction of the impulse with respect to the guide frame due to the moving body is in a direction other than the gravity direction, the displacement in the gravity direction of the guide frame can be performed due to the oscillating. Accordingly, it is possible to suppress the so-called slipping-out of nozzles in which liquid is leaked from the nozzles of the liquid ejecting head, since the impulsive force (acceleration) in the gravity direction which is applied to the moving body, and is generated when the liquid ejecting apparatus drops is relieved due to the displacement in the gravity direction of the guide frame which guides the moving body.

In the liquid ejecting apparatus, a second support unit which can support the guide frame in a direction which crosses the moving direction of the moving body with respect to the first support unit may be provided in the base frame.

According to the configuration, it is possible to stably support the oscillating of the guide frame, since the guide frame is supported by two support units.

In the liquid ejecting apparatus, a gap in a vertical direction may be provided between the base frame and the guide frame, in the second support unit.

According to the configuration, it is possible to cause the guide frame in which the moving direction is set to the axis line direction to easily oscillate, since the guide frame is supported by the two support units with respective gaps in the vertical direction, in the direction which crosses the moving direction. Accordingly, it is possible to further reliably relieve the impulsive force due to the oscillating.

In the liquid ejecting apparatus, the guide frame may be supported so as to move in a sliding manner toward the gravity direction side with respect to the base frame, in the support unit.

According to the configuration, it is possible to relieve the impulsive force which is applied to the guide frame by the moving body using the displacement of the guide frame which moves in the sliding manner toward the gravity direction side. Accordingly, it is possible to suppress the so-called slipping-out of nozzles in which liquid is leaked from the nozzles of the liquid ejecting head, since the impulsive force (acceleration) in the gravity direction which is applied to the moving body, and is generated when the liquid ejecting apparatus drops is relieved due to the displacement in the gravity direction of the guide frame which guides the moving body.

In the liquid ejecting apparatus, a pair of transporting rollers which relatively moves a medium with respect to the liquid ejecting head by interposing the medium to which the liquid is ejected therebetween may be further included, and the urging member may generate a pinching force of the medium in the pair of transporting rollers.

According to the configuration, it is possible to make the urging member which urges the guide frame be also used as an urging member which generates the pinching force of the transporting rollers.

In the liquid ejecting apparatus, at least one of a plurality of the support units which are provided in the moving direction of the moving body may relatively move with respect to the base frame along the moving direction of the moving body.

According to the configuration, when the base frame and the guide frame are formed of materials having different thermal expansion coefficients from each other, for example, it is possible to absorb a difference in the length due to thermal expansion which occurs in the moving direction of the moving body by causing the guide frame to move relatively. Accordingly, it is possible to suppress deformation of the guide frame by being bent.

BRIEF DESCRIPTION OF THE DRAWINGS

The invention will be described with reference to the accompanying drawings, wherein like numbers reference like elements.

FIG. 1 is a perspective view which illustrates a printer according to an embodiment in a state in which an outer case thereof is seen through.

FIGS. 4A and 4B are diagrams which schematically illustrate a structure in which the guide frame is attached to a base frame, in which FIG. 4A is a schematic view illustrating a state at the time of a normal use, and FIG. 4B is a schematic view which illustrates a state in which an impulsive force is applied to the carriage.

FIGS. 7A and 7B are diagrams which illustrate modification examples of structures in which the guide frame is attached to the base frame, in which FIG. 7A is a schematic diagram which illustrates a state at the time of a normal use, and FIG. 7B is a schematic diagram which illustrates a state in which an impulsive force is applied in the carriage.

DESCRIPTION OF EXEMPLARY EMBODIMENTS

Hereinafter, one embodiment of an ink jet printer as an example of a liquid ejecting apparatus which prints an image including characters, a figure, or the like, by ejecting ink as an example of liquid with respect to a sheet as an example of a medium from a liquid ejecting head having nozzles which can eject liquid will be described with reference to drawings.

Figure 1:
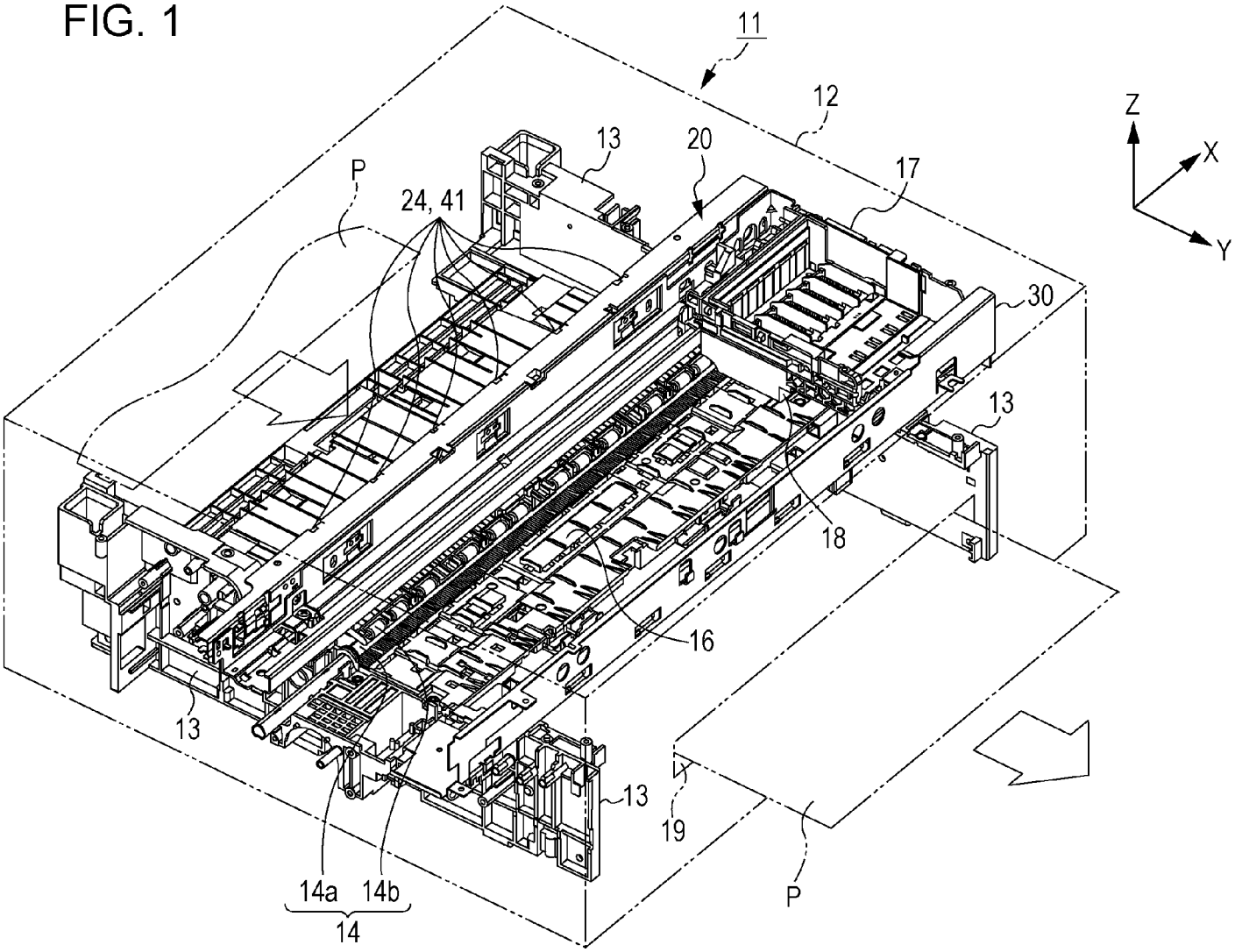
Figure 2:
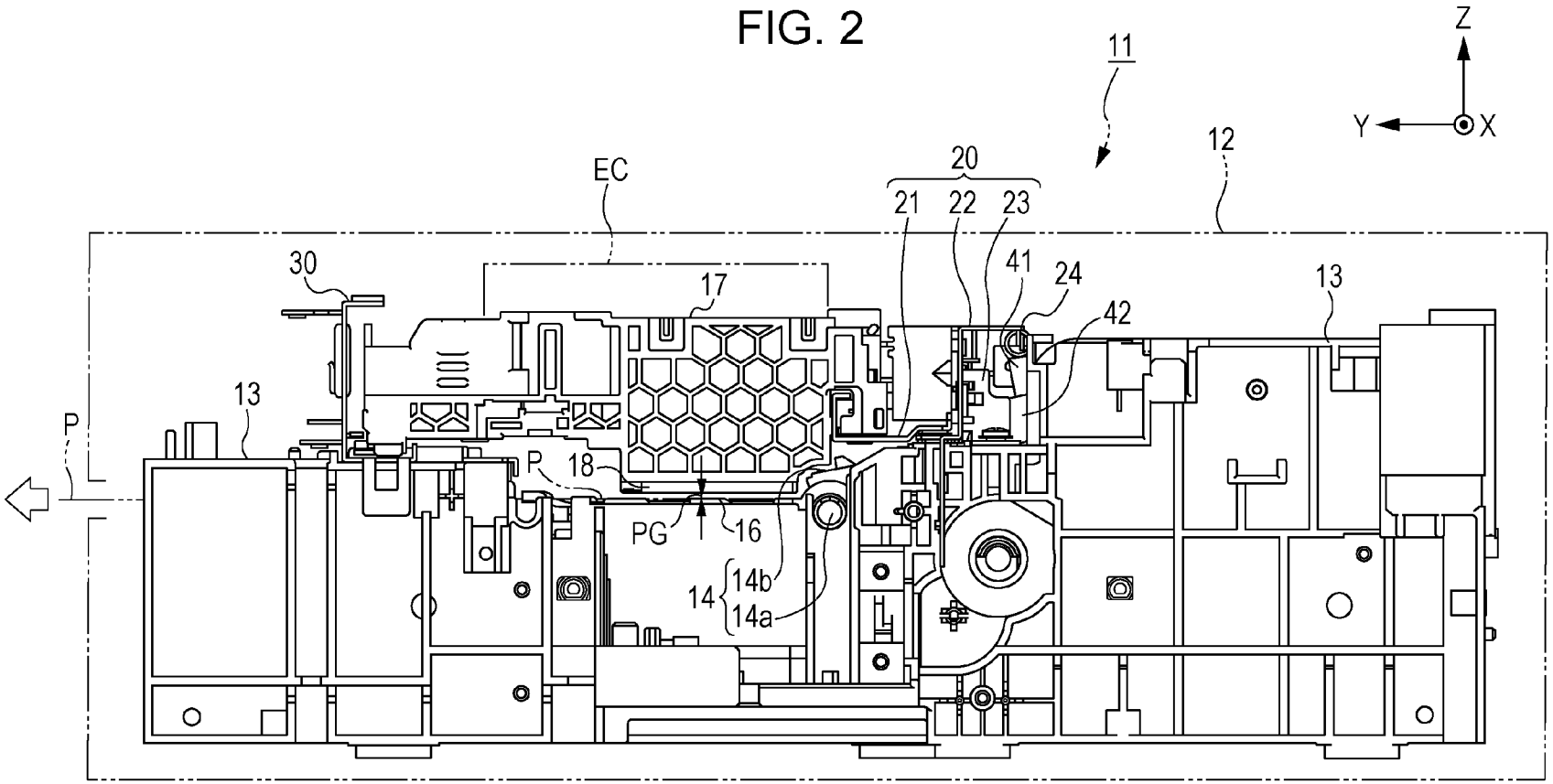
FIG. 2 is a side view in which the printer in FIG. 1 is viewed from a moving direction of a carriage.

As illustrated in FIGS. 1 and 2, a printer 11 according to the embodiment includes a base frame 13 to which an outer case 12, or the like, is attached, in which the outer case 12 is approximately a rectangular shape. A transporting path of a sheet P is formed in the base frame 13, and as illustrated in the figure using an outlined arrow, the sheet P is transported in a transporting direction Y along the transporting path. That is, the sheet P is transported by setting a direction going toward a supporting stand 16 which supports the sheet P, and which is formed on the upper side as a side opposite to gravity direction in a vertical direction Z of the base frame 13 to the transporting direction Y, while being interposed between a pair of transporting rollers 14 which is configured of a feeding roller 14*a* and a driven roller 14*b* which are rotatably driven by a not shown driving source. In addition, the transported sheet P is transported while being supported by the supporting stand 16 on the lower surface side which is the gravity direction side thereof.

In addition, the printer 11 is provided with a carriage 17 as an example of a moving body which can reciprocate along a moving direction X, by setting a direction which goes along a top face of the supporting stand 16, and crosses the transporting direction Y of the sheet P to the moving direction X. That is, the carriage 17 is guided by a guide frame 20 and a sub-guide frame 30 in which the moving direction X which is attached to the base frame 13 is set to a longitudinal direction, and reciprocates along the longitudinal direction on the supporting stand 16. The carriage 17 is provided with a liquid ejecting head 18 which can eject ink, and on which an ink cartridge EC as an example of a fluid storing container which can store ink can be mounted, and ink is supplied to the liquid ejecting head 18 from the ink cartridge EC which is mounted on the carriage 17.

According to the embodiment, the driven roller 14*b* of the pair of transporting rollers 14 is rotatably supported in the other end side of an oscillating body 42 (refer to FIG. 3) in which one end of a tension coil spring 41 as an example of the urging member is locked in one end side thereof. The oscillating body 42 can oscillate in the guide frame 20 by setting an approximately center portion thereof to a center, and urges the driven roller 14*b* at all times with respect to the feeding roller 14*a* using a tensile force of the tension coil spring 41. In addition, in the tension coil spring 41 of which one end is locked in the oscillating body 42, the other end thereof is locked in a locking portion 24 which is provided in the guide frame 20. Accordingly, the tension coil spring 41 causes a tensile force to work with respect to the locking portion 24 of the guide frame 20. In addition, according to the embodiment, a plurality of (six, here) the locking portions 24 are provided by being aligned in the moving direction X of the carriage 17, and the other ends of tension coil springs 41 are locked in respective locking portions 24.

The guide frame 20 and the sub-guide frame 30 are formed by plate members, respectively, and are arranged on the base frame 13 with a gap between each other in the transporting direction Y. That is, the guide frame 20 is located on the upstream side in the transporting direction Y, and the sub-guide frame 30 is located the downstream side in the transporting direction Y. In addition, the guide frame 20 and the sub-guide frame 30 support the carriage 17 from the gravity direction side in a state in which the carriage can be moved in the moving direction X in both sides of the transporting direction Y interposing the liquid ejecting head 18 therebetween.

The liquid ejecting head 18 moves with a predetermined gap PG between the liquid ejecting head and the supporting stand 16 when moving along with the carriage 17 which moves by being guided by the guide frame 20 and the sub-guide frame 30. In addition, an image is printed by ejecting ink which is supplied from the ink cartridge EC with respect to the sheet P which is transported on the supporting stand 16 from not shown nozzles which are provided on the lower surface side of the liquid ejecting head 18 in the middle of moving. The sheet P on which the image is printed is discharged from a sheet discharge port 19 which is provided in the outer case 12 in the front side as the front side in the transporting direction Y.

In addition, a stacker which is movably arranged between a position accommodated in the outer case 12 and a position extracted to the outside of the outer case 12, and can receive the sheet P which is discharged from the sheet discharge port 19 may be provided on the lower side of the sheet discharge port 19. In addition, an operating member for executing ejecting of liquid from the liquid ejecting head 18, or the like, and a printing operation, or the like, or a display member, or the like, such as a liquid crystal device, for example, may be included.

Meanwhile, as illustrated in FIG. 2, the guide frame 20 which is included in the printer 11 according to the embodiment is configured of three sub-frames which are formed using a plate member, respectively, that is, a first sub-frame 21, a second sub-frame 22, and a third sub-frame 23. Subsequently, each sub-frame will be described with reference to FIG. 3.

Figure 3:
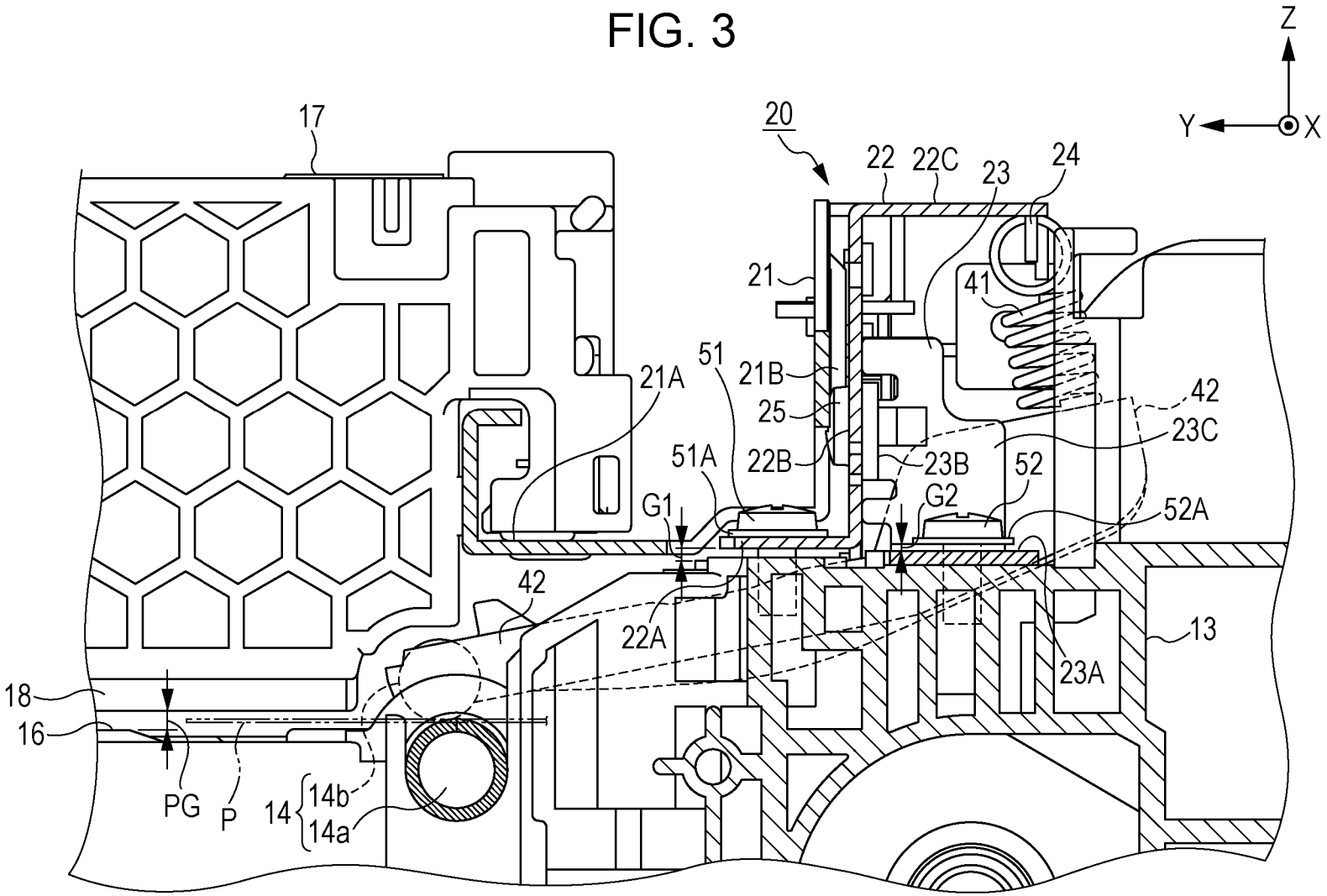
FIG. 3 is an enlarged view which illustrates a configuration of a guide frame which guides a movement of the carriage.

As illustrated in FIG. 3, the first sub-frame 21 is provided with a guide rail unit 21A which guides the movement of the carriage 17 by bending of the member in an approximately U shape in a side end portion of the plate member in the transporting direction Y. The carriage 17 reciprocates along the moving direction X as the longitudinal direction of the guide rail unit 21A while being supported in the rear end side as the upstream side in the transporting direction Y by the guide rail unit 21A. In addition, a wall portion 21B which is bent approximately perpendicularly toward the upper part in the vertical direction Z in which the member is orthogonal to the transporting direction Y is provided in the side end portion which is the side opposite to the transporting direction Y of the plate member of the first sub-frame 21.

The second sub-frame 22 is provided with a vertical portion 22B in which a plate surface of the plate member is extended in both the moving direction X and the vertical direction Z, and a lower horizontal portion 22A which is bent approximately perpendicularly so as to be extended in the moving direction X and the transporting direction Y in the lower end portion as the gravity direction side of the vertical portion 22B. In addition, an upper horizontal portion 22C which is bent approximately perpendicularly so that the plate member is extended to a side opposite to the moving direction X and the transporting direction Yis provided, in the upper side end portion on the side opposite to gravity direction of the vertical portion 22B. A movement of the wall portion 21B of the first sub-frame 21 and the vertical portion 22B of the second sub-frame 22 in the plate thickness direction with respect to each other is suppressed, and the wall portion and the vertical portion are attached so as to relatively move in the vertical direction which goes along the plate surface direction thereof. In addition, a position in the vertical direction of the first sub-frame 21 with respect to the second sub-frame 22 can be adjusted by a not shown cam mechanism, or the like, for example.

The third sub-frame 23 is provided with a base end portion 23A at which the plate surface of the plate member is extended along both the transporting direction Y and the moving direction X, and two side wall portions 23C which are bent approximately perpendicularly in both side ends of the base end portion 23A in the moving direction X, respectively. A fixing portion 23B in which a part of the plate member is bent so as to be extended in the vertical direction Z and the moving direction X is respectively formed in each of side wall portions 23C, and the third sub-frame 23 is fixed on the upstream side in the transporting direction Y with respect to the second sub-frame 22 when the vertical portion 22B of the second sub-frame 22 is fixed to the fixing portion 23B using a set screw 25. In addition, only one fixing portion 23B is illustrated in FIG. 3.

Accordingly, in the guide frame 20 according to the embodiment, the first sub-frame 21, the second sub-frame 22, and the third sub-frame 23 are integrated in a state in which a position of the first sub-frame 21 in the vertical direction with respect to the second sub-frame 22 is adjusted. In addition, the guide frame 20 in a state of being integrated has a predetermined gap with respect to the base frame 13 in the vertical direction Z, and is attached by being urged by the tension coil spring 41 as the urging member.

That is, the guide frame 20 is provided with through holes in the lower horizontal portion 22A of the second sub-frame 22 at two (plurality of) positions with a gap in at least the moving direction X, respectively, and is attached to the base frame 13 by a first fixing screw 51 which is inserted into the through hole, and is fixed to the base frame 13. Accordingly, the movement of the guide frame 20 in both the transporting direction Y and the moving direction X of the second sub-frame 22 is suppressed in the state in which the guide frame is attached to the base frame 13 using the first fixing screw 51. In addition, according to the embodiment, a gap in the vertical direction Z is provided between the lower horizontal portion 22A of the second sub-frame 22 which is attached using the first fixing screw 51 and the base frame 13. In other words, the guide frame 20 is supported in a state in which the guide frame can move in the vertical direction Z with respect to the base frame 13, using the first fixing screw 51. As a result, the first fixing screw 51 which is fixed to the base frame 13 functions as a support unit (first support unit) which supports the guide frame 20 in the base frame 13. In addition, according to the embodiment, a flange portion 51A using an integral member, a separate member such as a washer, or the like, is provided in the first fixing screw 51.

In addition, the guide frame 20 is provided with through holes in the base end portion 23A of the third sub-frame 23 at two positions with a gap in at least the moving direction X, respectively, and the guide frame is attached by a second fixing screw 52 which is inserted into the through hole, and is fixed to the base frame 13. Accordingly, the movement of the guide frame 20 in both the transporting direction Y and the moving direction X of the third sub-frame 23 is suppressed in a state in which the guide frame is attached using the second fixing screw 52. In addition, according to the embodiment, the base end portion 23A of the third sub-frame 23 which is attached using the second fixing screw 52 is provided with a gap in the vertical direction Z with respect to the base frame 13. In other words, the guide frame 20 is supported in a state in which the guide frame can move in the vertical direction Z with respect to the base frame 13 using the second fixing screw 52. As a result, the second fixing screw 52 which is fixed to the base frame 13 using a screw functions as a support unit (second support unit) which supports the guide frame 20 in the base frame 13. In addition, according to the embodiment, a flange portion 52A using an integral member, a separate member such as a washer, or the like, is provided in the second fixing screw 52.

According to the embodiment, in this manner, the first fixing screw 51 and the second fixing screw 52 fix the guide frame 20 at a plurality of positions at which gaps are provided in the moving direction X, and positions at which gaps are provided with each other in the transporting direction Y, as well, by providing a gap in the vertical direction Z with respect to the base frame 13. In addition, the tension coil spring 41 urges an end portion of the upper horizontal portion 22C of the second sub-frame 22 at which the locking portion 24 in which one end of the tension coil spring is locked is provided so as to be pulled toward the gravity direction side using a tensile force which works in the locking portion 24.

At this time, according to the embodiment, the locking portion 24 in which the tensile force of the tension coil spring 41 works is located on the upstream side of the second fixing screw 52 in the transporting direction Y. As a result, the guide frame 20 is urged so that the base end portion 23A of the third sub-frame 23 is pushed toward the base frame 13 which is located on the gravity direction side. In addition, the base end portion 23A forms a gap G2 which can be displaced on the side opposite to gravity direction between the base end portion and the flange portion 52A of the second fixing screw 52 in a state of being in contact with the base frame 13 by being pushed. On the other hand, the lower horizontal portion 22A of the second sub-frame 22 is urged toward the side opposite to gravity direction by the tensile force of the tension coil spring 41, using the base end portion 23A as a fulcrum. In addition, a displacement of the lower horizontal portion 22A which is urged toward the side opposite to gravity direction is regulated when being abutted onto the flange portion 51A which is provided in the first fixing screw 51. The lower horizontal portion 22A forms a gap G1 which can be displaced on the gravity direction side between the lower horizontal portion and the base frame 13 in a state of being regulated in the displacement due to the abutting.

In addition, as illustrated in FIG. 3, according to the embodiment, the guide frame 20 performs positioning of the carriage 17 which is supported by the first sub-frame 21 at a position at which a gap PG between the liquid ejecting head 18 and the supporting stand 16 has a dimension appropriate for printing on the sheet P, in a state in which the lower horizontal portion 22A of the second sub-frame 22 abuts onto the flange portion 51A of the first fixing screw 51. That is, when the first sub-frame 21 is moved with respect to the second sub-frame 22 in the vertical direction Z using a not shown cam mechanism, or the like, in a state in which the lower horizontal portion 22A abuts onto the flange portion 51A of the first fixing screw 51, it is possible to appropriately adjust the gap PG between the liquid ejecting head 18 and the supporting stand 16 according to the sheet P.

Subsequently, operations of the printer 11 according to the embodiment will be described with reference to FIGS. 4A and 4B. In addition, in FIGS. 4A and 4B, the guide frame 20 is schematically illustrated in a state in which the first sub-frame 21, the second sub-frame 22, and the third sub-frame 23 are integrated, and the carriage 17 will be also illustrated by schematically illustrating a part thereof.

Figure 4A:
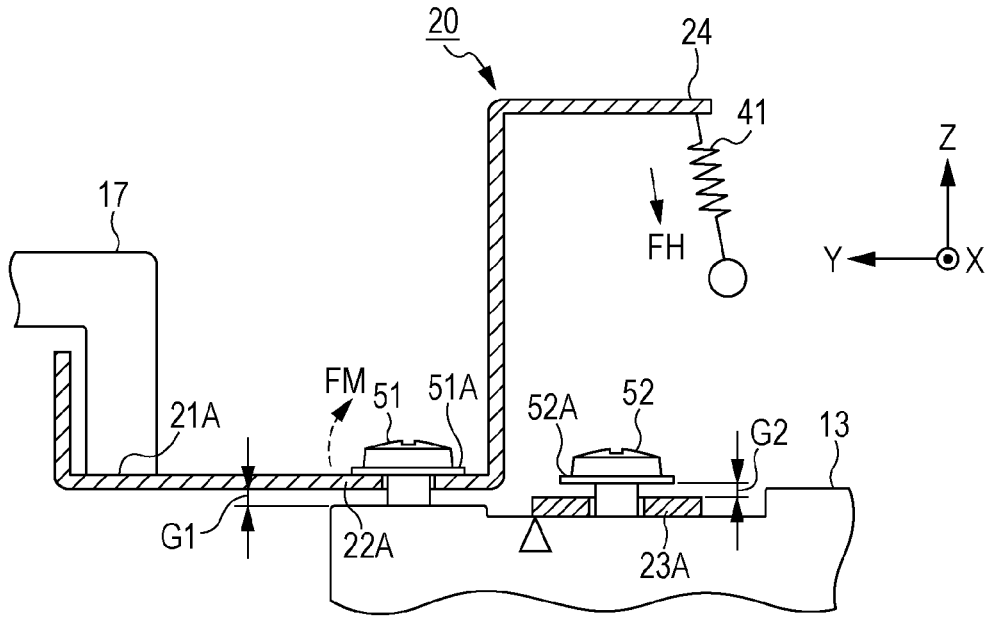

As illustrated in FIG. 4A, in the printer 11 at the time of a normal use such as printing, a rotating force FM works in the guide frame 20 by setting a part of the base end portion 23A which comes into contact with the base frame 13 to a fulcrum by a tensile force FH of the tension coil spring 41. That is, as illustrated using a black triangle in FIG. 4A, for example, the rotating force FM causes a state in which the lower horizontal portion 22A is abutted onto the flange portion 51A of the first fixing screw 51 by being displaced so as to be lifted by setting an end portion of the base end portion 23A in the transporting direction Y side to a fulcrum. Accordingly, the rotating force FM urges the carriage 17 toward the upper part which is the side opposite to gravity direction from the lower side so that the carriage 17 which is supported by the guide frame 20 does not fall to the gravity direction side which is the side on which the supporting stand 16 is located. As a result, the adjusted gap PG between the liquid ejecting head 18 and the supporting stand 16 is maintained. In addition, a fulcrum at the time of oscillating will be denoted by a black triangle in each figure which will be referred to in the following descriptions.

Figure 4B:
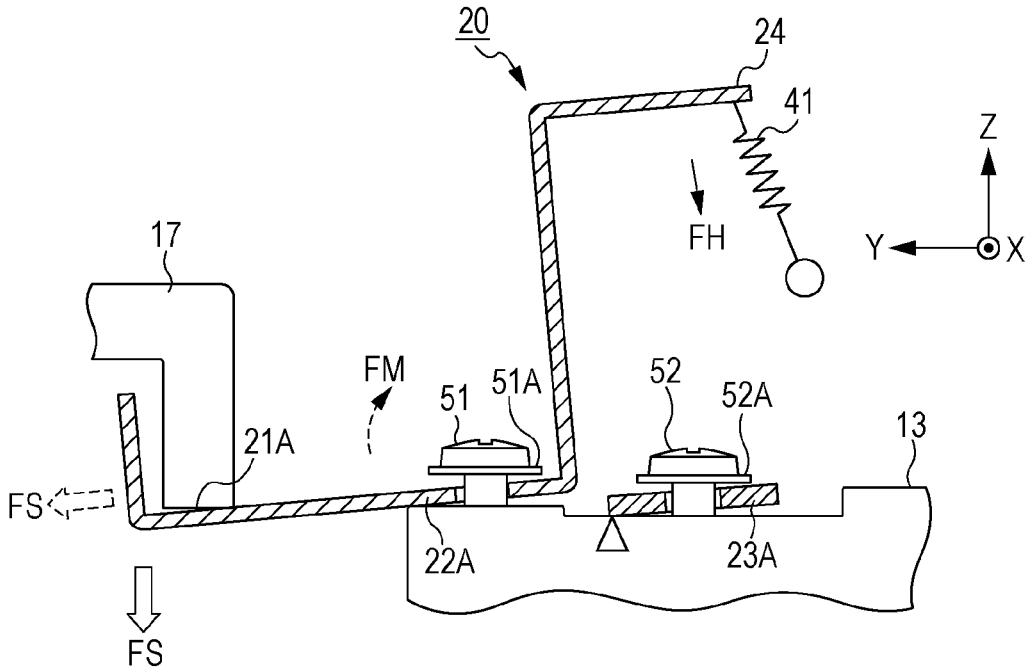

Subsequently, as illustrated in FIG. 4B, when the printer 11 drops, and the impulsive force FS in the gravity direction is applied to the carriage 17, for example, the guide frame 20 oscillates so that the guide rail unit 21A side which supports the carriage 17 falls in the gravity direction by setting the end portion of the base end portion 23A in the transporting direction Y side to a fulcrum. In addition, in the base end portion 23A, a rear end portion on the side which is opposite to the transporting direction Y is lifted by setting a front end portion in the transporting direction Y side as a fulcrum. As a result, the guide frame 20 oscillates with respect to the base frame 13 by setting the moving direction X of the carriage 17 to an axis line direction. In other words, the guide frame 20 is supported so as to oscillate with respect to the base frame 13 by setting the moving direction X of the carriage 17 to the axis line direction in the first and second fixing screws 51 and 52 which are the support units.

In the oscillation processing of the guide frame 20, since the rotating force FM due to the tensile force FH of the tension coil spring 41 works with respect to the guide frame 20, the impulsive force FS is relieved so as to be gradually weakened, and is lost due to the rotating force FM. As a result, a magnitude of acceleration in the gravity direction which is generated in the carriage 17 is suppressed while the movement of the carriage 17 in the gravity direction is stopped. In addition, when the guide frame 20 oscillates, the lower horizontal portion 22A can be displaced in the gap G1 along an axial portion of the first fixing screw 51. In addition, the base end portion 23A can be displaced so as not to come into contact with the flange portion 52A of the second fixing screw 52 by the gap G2. In other words, the gaps G1 and G2 are set to dimensions in which the lower horizontal portion 22A and the base end portion 23A can be displaced respectively, in an oscillating range of the guide frame 20 in which the impulsive force FS can be relieved due to the rotating force FM. Originally, the dimension in which the displacement can be performed may be a dimension in which the guide frame 20 (lower horizontal portion 22A) comes into contact with the base frame 13 before the impulsive force FS is lost, when the impulsive force can be relieved due to the rotating force FM up to a range in which ink is not ejected from the liquid ejecting head 18.

In addition, it is possible to relieve the impulsive force FS by adopting a configuration in which the guide frame 20 can oscillate with respect to the base frame 13 by setting the moving direction X of the carriage 17 to the axis line direction in this manner, even when the impulsive force FS is applied to a direction other than the gravity direction which deviates from the gravity direction as denoted by an outlined dashed arrow in FIG. 4B. That is, the guide frame 20 oscillates so that the side which supports the carriage 17 falls in the gravity direction by setting the end portion of the base end portion 23A in the transporting direction Y to a fulcrum.

According to the embodiment, the following effects can be obtained (1) The lower horizontal portion 22A of the guide frame 20 is positioned so as not to be displaced toward the side opposite to gravity direction using abutting at the time of a normal use such as printing, and on the other hand, the lower horizontal portion can be displaced toward the gravity direction side while resisting the tensile force (urging force) of the tension coil spring 41 due to the gap G1 which is present on the gravity direction side. Accordingly, since the impulsive force FS (acceleration) in the gravity direction which is applied to the carriage 17, and is generated when the printer 11 drops is relieved due to the displacement of the guide frame 20 (lower horizontal portion 22A) in the gravity direction, which guides the carriage 17, deformation of the guide frame 20 is suppressed, and the so-called slipping-out of nozzles in which ink is leaked from the nozzles of the liquid ejecting head 18 is suppressed.

(2) Even when the direction of the impulsive force FS which is applied to the guide frame 20 by the carriage 17 is a direction other than the gravity direction, it is possible to make the guide frame 20 be displaced in the gravity direction due to the oscillating. Accordingly, since the impulsive force FS (acceleration) in the gravity direction which is applied to the carriage 17, and is generated when the printer 11 drops is relieved by the displacement of the guide frame 20 in the gravity direction, which guides the carriage 17, the so-called slipping-out of nozzles in which ink is leaked from the nozzles of the liquid ejecting head 18 is suppressed.

(3) Since the guide frame 20 is supported by two support units which have the gaps G1 and G2, respectively, in the vertical direction Z, in the transporting direction Y which crosses the moving direction X, it is possible to cause the guide frame 20 in which the moving direction X is set to the axis direction to easily oscillate. Accordingly, it is possible to further reliably relieve the impulsive force FS due to oscillating.

(4) It is possible to make the urging member which urges the guide frame 20 be also used as the tension coil spring 41 as an e urging member which generates a pinching force of the pair of transporting rollers.

In addition, the embodiment can be modified as follows.

According to the embodiment, only one first fixing screw 51 as the support unit which has a gap between the lower horizontal portion 22A and the base frame 13 in the gravity direction may be provided. That is, the guide frame (second sub-frame 22) may be attached to the base frame 13 using one first fixing screw 51. In this case, the guide frame 20 may be fixed to the base frame 13 in the vertical direction Z without a gap using a fixing member at at least one place other than that. In addition, when one first fixing screw 51 is provided, the first fixing screw may be provided at an approximately center position of the guide frame 20 in the moving direction X. In this manner, since the guide frame 20 can be displaced on both sides by interposing approximately a center position thereof therebetween in the gravity direction, it is possible to relieve the impulsive force FS (acceleration) in the gravity direction which is applied to the carriage 17 in a wide range in the moving direction X.

According to the embodiment, the guide frame 20 may not necessarily be supported by the two support units which have the gap G1 on the gravity direction side and the gap G2 on the side opposite to gravity direction in the transporting direction Y with respect to the base frame 13. The modification examples will be described with reference to FIGS. 5A to 5C.

Figure 5A:
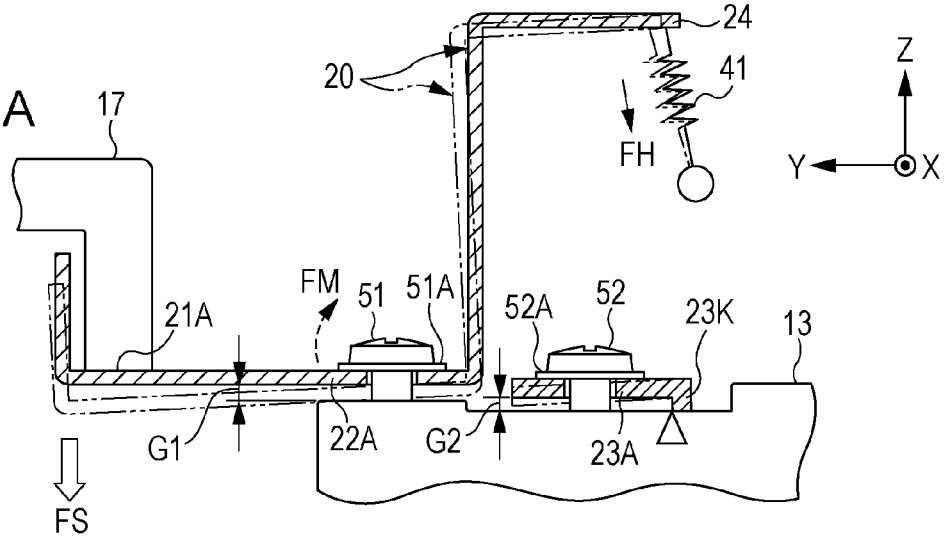
FIGS. 5A to 5C are all schematic views which illustrate modification examples of structures in which the guide frame is attached.

As illustrated in FIG. 5A, by forming a hooked portion 23K which is bent in an L shape at the end portion on the side which is opposite to the transporting direction Y side in the base end portion 23A which is supported by the second fixing screw 52, the gap G2 may be provided between the base end portion and the base frame 13 which is the gravity direction side of the base end portion 23A. In this case, a fulcrum at a time of oscillating is located at the hooked portion 23K which is provided in the base end portion 23A, and the guide frame 20 can oscillate as denoted by a two-dot chain line in the figure when the impulsive force FS is applied to the guide frame.

Figure 5B:
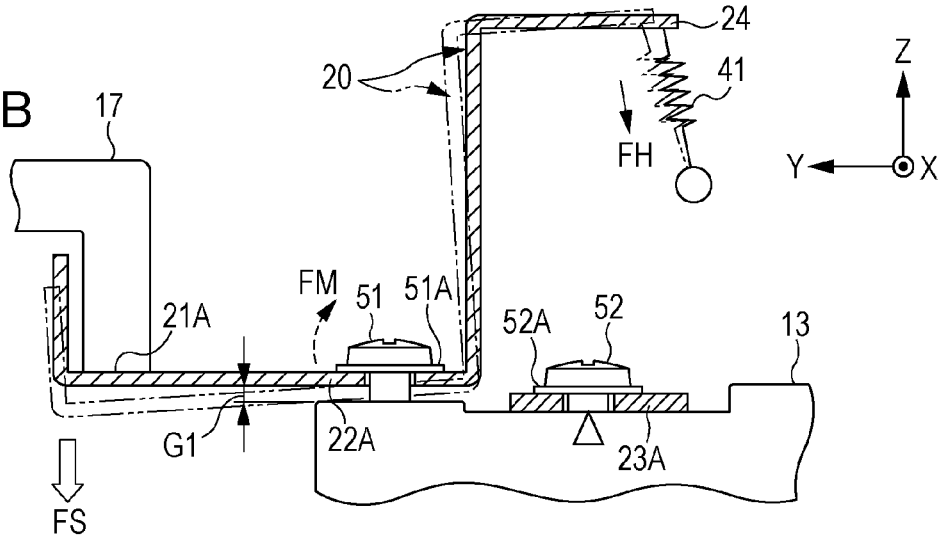

Alternatively, as illustrated in FIG. 5B, the base end portion 23A may be supported by the second fixing screw 52 without providing the gap G2 between the base end portion and the second fixing screw 52 in the vertical direction Z. That is, the base end portion 23A may be tightly fixed to the base frame 13 using the second fixing screw 52 without a gap in the vertical direction Z. In this case, a fulcrum of the guide frame 20 at a time of oscillating becomes approximately the axial portion of the second fixing screw 52, and the guide frame 20 can be oscillated due to twist deformation which occurs according to rigidity of the guide frame 20 as denoted by a two-dot chain line in the figure when the impulsive force FS is applied to the guide frame.

Figure 5C:
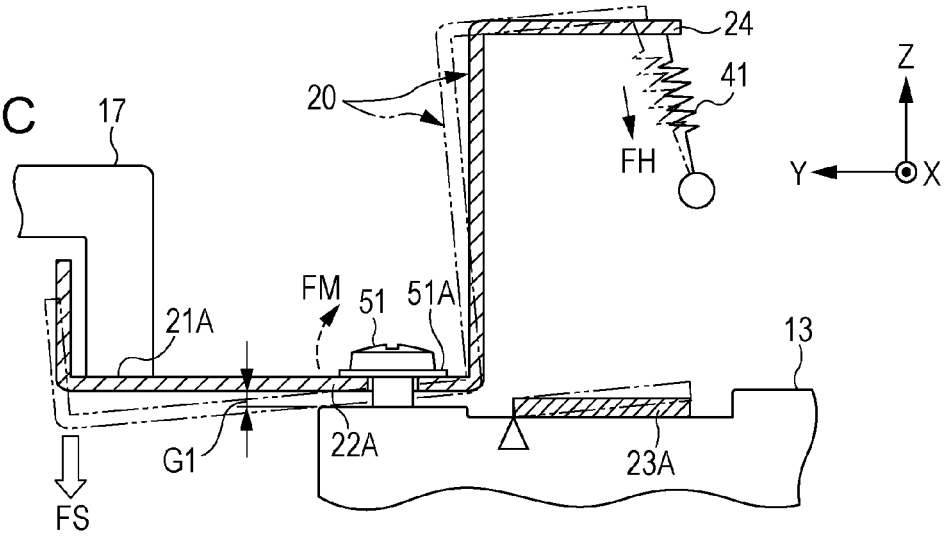

Alternatively, as illustrated in FIG. 5C, the base end portion 23A may not be attached to the base frame 13 using the second fixing screw 52. That is, the second support unit may not be provided. For example, when the base end portion 23A comes into contact with the base frame 13 due to the tensile force of the tension coil spring 41, the fulcrum at a time of oscillating becomes the end portion of the base end portion 23A on the transporting direction Y side, even if the second fixing screw 52 is not used, and when the impulsive force FS is applied to the base end portion, the base end portion can oscillate as denoted by a two-dot chain line in FIG. 5C, similarly to the embodiment which is denoted in FIG. 4B.

According to the embodiment, the urging member which urges the guide frame 20 may not necessarily be an urging member which generates a pinching force of the sheet P in the pair of transporting rollers 14. The modification examples will be described with reference to FIGS. 6A and 6B.

Figure 6A:
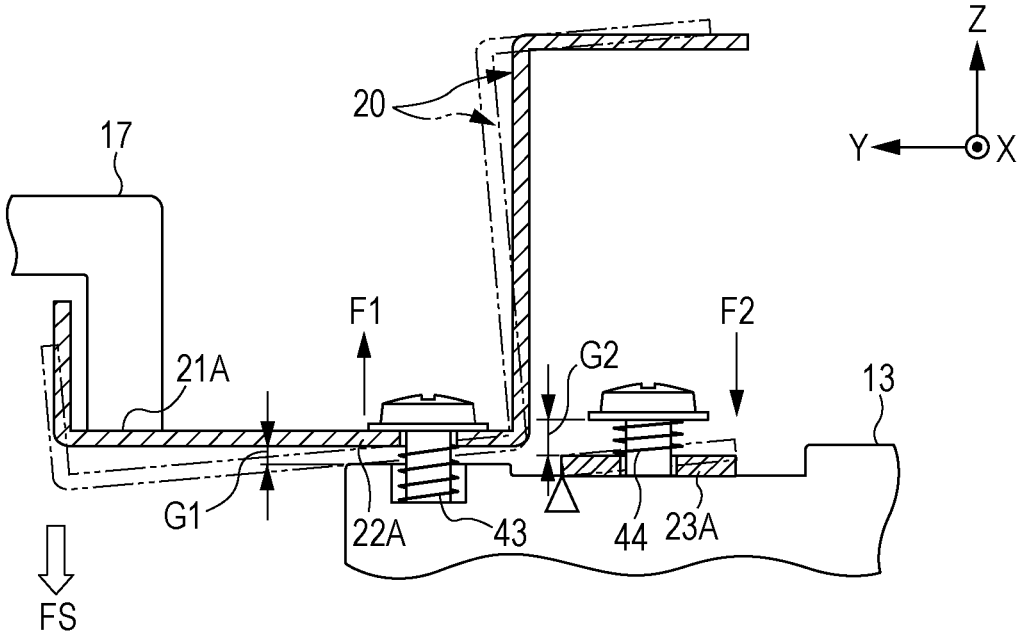
FIGS. 6A and 6B are schematic diagrams which illustrate modification examples of urging members which urge the guide frame.

As illustrated in FIG. 6A, in the first fixing screw 51 as the first support unit, the lower horizontal portion 22A is urged to the side opposite to gravity direction which is denoted by a solid arrow F1 in the figure so that the lower horizontal portion comes into contact with the flange portion 51A of the first fixing screw 51 by causing a first compression coil spring 43 as the urging member which is inserted into the axial portion thereof to be interposed between the lower horizontal portion 22A and the base frame 13. On the other hand, in the second fixing screw 52 as the second support unit, the base end portion 23A is urged to the gravity direction side which is denoted by a solid arrow F2 in the figure so that the base end portion comes into contact with the base frame 13 by causing a second compression coil spring 44 as the urging member which is inserted into the axial portion thereof to be interposed between the base end portion 23A and the flange portion 52A of the second fixing screw 52. As a result, the fulcrum of the guide frame 20 at a time of oscillating when being applied with the impulsive force FS becomes the end portion of the base end portion 23A on the transporting direction Y side, and the guide frame 20 oscillates as denoted by a two-dot chain line in the figure.

Figure 6B:
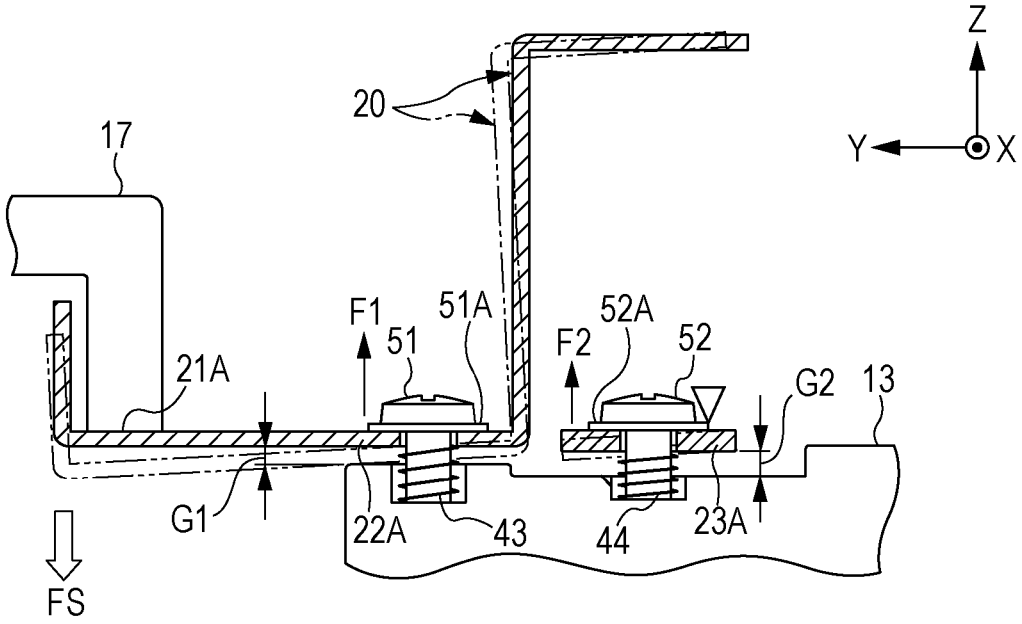

Alternatively, as illustrated in FIG. 6B, in the first fixing screw 51 as the first support unit, the lower horizontal portion 22A is urged to the antigravity direction side which is denoted by the solid arrow F1 in the figure so that the lower horizontal portion comes into contact with the flange portion 51A of the first fixing screw 51 by causing the first compression coil spring 43 as the urging member which is inserted into the axial portion of the first fixing screw to be interposed between the lower horizontal portion 22A and the base frame 13. Similarly, in the second fixing screw 52 as the second support unit, the base end portion 23A is urged toward the antigravity direction side which is denoted by the solid arrow F2 in the figure so that the base end portion comes into contact with the flange portion 52A of the second fixing screw 52 by causing the second compression coil spring 44 as the urging member which is inserted into the axial portion of the second fixing screw to be interposed between the base end portion 23A and the base frame 13. As a result, the fulcrum of the guide frame 20 at a time of oscillating when being applied with the impulsive force FS becomes the end portion on the side opposite to the transporting direction Y in the flange portion 52A, and the guide frame 20 oscillates as denoted by a two-dot chain line in the figure.

According to the embodiment, the guide frame 20 may not necessarily be supported so as to be oscillated with respect to the base frame 13. For example, the guide frame may be movably supported in a sliding manner in the vertical direction Z with respect to the base frame. The modification examples will be described with reference to FIGS. 7A and 7B.

Figure 7A:
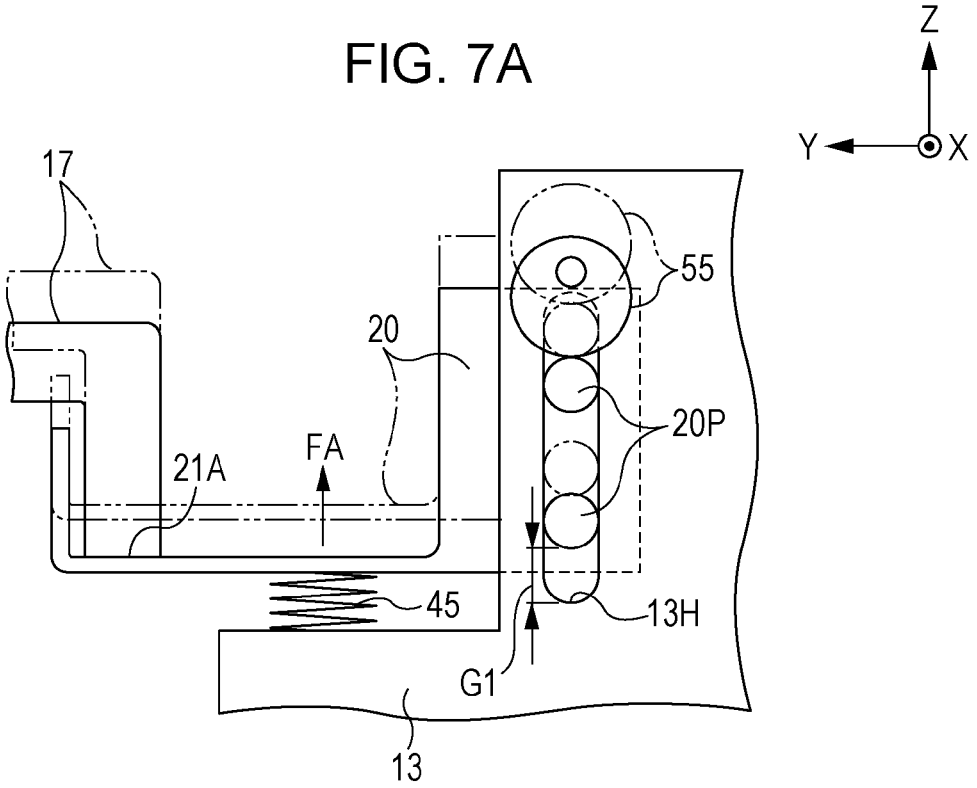

As illustrated in FIG. 7A, the guide frame 20 in the modification example includes two guide pins 20P which are arranged with a gap in the vertical direction Z in the end portion on the side which is opposite to the guide rail unit 21A on the transporting direction Y side on which the carriage 17 is supported. On the other hand, an elliptical guide hole 13H in which the two guide pins 20P can slide along the vertical direction Z is provided in the base frame 13. In addition, the guide frame 20 is supported so as to be moved in a sliding manner in the vertical direction Z by the base frame 13, and is urged toward the side opposite to gravity direction by a compression spring 45 as an example of the urging member which is inserted between the guide frame and the base frame 13 in a state in which the two guide pins 20P of the guide frame 20 are inserted into the guide hole 13H of the base frame 13. Accordingly, the guide hole 13H functions as the support unit of the guide frame 20.

A position of the guide frame 20 in the vertical direction Z is determined by being abutted onto the guide pin 20P and a rotating cam 55 when the rotating cam 55 which is axially supported by the base frame 13, rotatably, comes into contact with the upper guide pin 20P which is urged toward the side opposite to gravity direction on the upper part. That is, as denoted by a two-dot chain line in the figure, the guide frame 20 which is urged by the compression spring 45 according to a rotation state of the rotating cam 55 vertically moves along the vertical direction Z, and the gap PG between the liquid ejecting head 18 and the supporting stand 16 which is provided in the carriage 17 supported by the guide frame 20 is adjusted so as to fit to the sheet P. In the printer 11 at the time of a normal use such as printing, the carriage 17 is urged toward the side opposite to gravity direction by the compression spring 45, and the adjusted gap PG between the liquid ejecting head 18 and the supporting stand 16 is maintained.

Figure 7B:
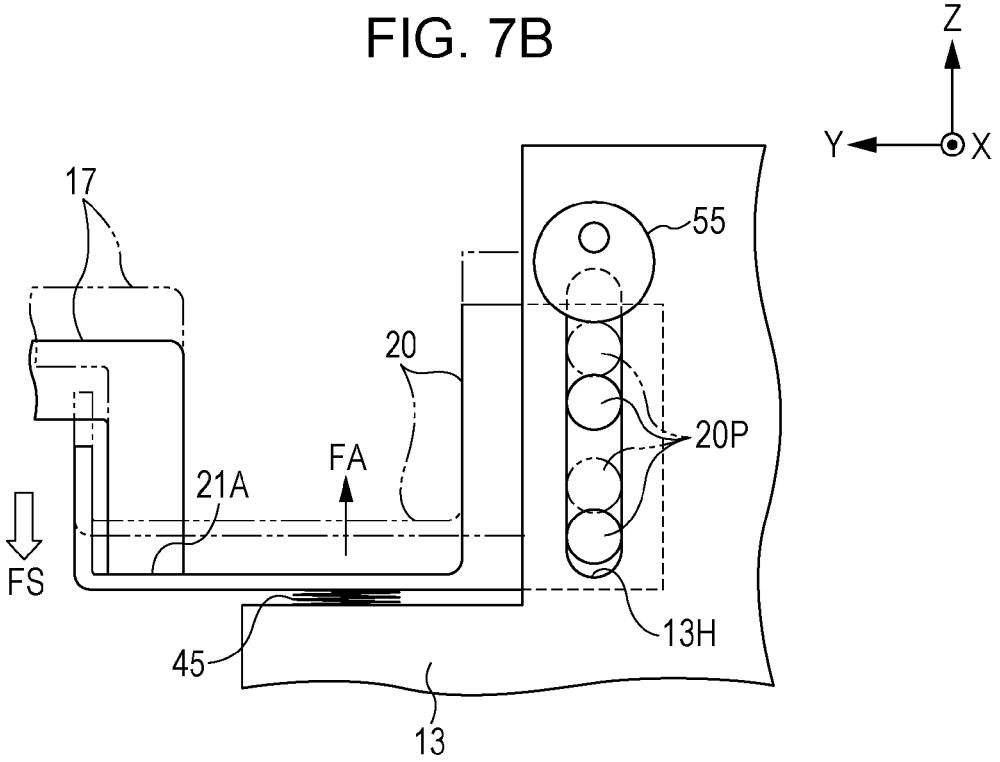

Subsequently, as illustrated in FIG. 7B, for example, when the printer 11 drops, and the impulsive force FS is applied to the carriage 17 in the gravity direction, the guide frame 20 is displaced as denoted by a solid line which is changed from a two-dot chain line in the figure when the guide pin 20P moves in a sliding manner to the lower part by sliding the guide hole 13H by separating from the rotating cam 55, that is, to the gravity direction side.

In the displacement of the guide frame 20 toward the gravity direction side in which the guide frame moves in a sliding manner, since a compressive force FA of the compression spring 45 works in the guide frame 20 on the side opposite to gravity direction, the impulsive force FS is relieved by being gradually weakened by the compressive force FA. As a result, a magnitude of acceleration in the gravity direction which is generated in the carriage 17 until the movement of the carriage 17 in the gravity direction is stopped is suppressed. In addition, at the time of displacement of the guide frame 20, the gap G1 with a changeable dimension is set between the guide pin and the guide hole 13H on the gravity direction side of the guide pin 20P so that the guide pin 20P does not come into contact with the guide hole 13H. Originally, the dimension in which the displacement can be performed may be a dimension in which the guide pin 20P comes into contact with the guide hole 13H before the impulsive force FS is lost, for example, when the impulsive force can be relieved due to the compressive force FA up to a range in which ink is not ejected from the liquid ejecting head 18.

According to the modification example, the following effect can be obtained.

(5) It is possible to relieve the impulsive force FS which is applied to the guide frame 20 by the carriage 17 using the displacement of the guide frame 20 which moves to the gravity direction side. Accordingly, since the impulsive force FS (acceleration) which is applied to the carriage 17 in the gravity direction, and is generated when the printer 11 drops is relieved due to the displacement of the guide frame 20 which guides the carriage 17 in the gravity direction, the so-called slipping-out of nozzles in which ink is leaked from the nozzles of the liquid ejecting head 18 is suppressed.

According to the embodiment, in at least one of the plurality of support units which are provided in the moving direction X of the carriage 17, the guide frame 20 may relatively move with respect to the base frame 13 along the moving direction X of the carriage. The modification example will be described with reference to FIG. 8.

Figure 8:
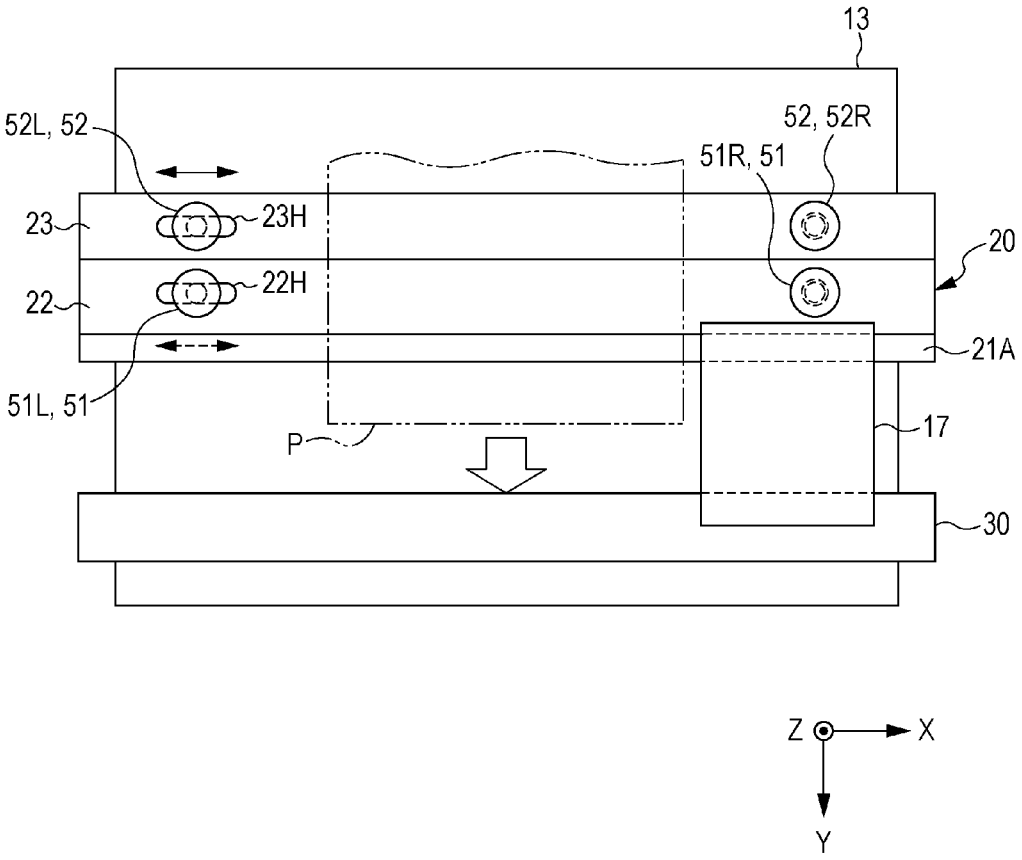
FIG. 8 is a schematic diagram which illustrates a structure with the guide frame which can relatively move in the moving direction of the carriage with respect to the base frame.

As illustrated in FIG. 8, according to the modification example, a plurality of (two, here) first and second support units which support the guide frame 20 are provided in the base frame 13 in the moving direction X of the carriage 17, respectively. That is, the guide frame 20 is supported by the base frame 13 using two first fixing screws 51 which function as the first support unit, and two second fixing screws 52 which function as the second support unit at two positions of the carriage 17 in the moving direction X.

In addition, here, an axial portion of one first fixing screw 51R on the right side when viewed from the transporting direction Y between the two first fixing screws 51 is inserted into a round hole (through hole) with approximately the same dimension which is provided in the guide frame 20, and an axial portion of the other first fixing screw 51L on the left side is inserted into an elliptical hole 22H (through hole) which is provided in the guide frame 20 (second sub-frame 22). Similarly, an axial portion of one second fixing screw 52R on the right side when viewed from the transporting direction Y is inserted into a round hole (through hole) with approximately the same dimension which is provided in the guide frame 20, and an axial portion of the other second fixing screw 52L on the left side is inserted into an elliptical hole 23H (through hole) which is provided in the guide frame 20 (third sub-frame 23).

As a result, when the base frame 13 expands and contracts as denoted by a solid arrow in both sides in FIG. 8, and the guide frame 20 expands and contracts as denoted by a dashed arrow in both sides in FIG. 8 due to thermal expansion, for example, there is a relative movement of the guide frame 20 and the base frame 13 due to a difference in thermal expansion coefficient in the moving direction X. Even in such a case, stress with respect to the guide frame 20 is suppressed since positions of the first fixing screw 51L and the second fixing screw 52L on the left are deviated in the elliptical holes 22H and 23H. In addition, according to the modification example, a position of the guide frame 20 with respect to the base frame 13 in the moving direction X is positioned based on the positions of the first fixing screw 51R and the second fixing screw 52R on the right. Accordingly, it is preferable that a movement of the carriage 17 be suppressed by setting the side which is close to the positions of the first fixing screw 51R and the second fixing screw 52R on the right to a reference position such as a zero digit, or the like.

According to the modification example, the following effect is obtained.

(6) When the base frame 13 and the guide frame 20 are formed using materials of which thermal expansion coefficients are different from each other, for example, a difference in length which occurs in the moving direction X of the carriage 17 due to the thermal expansion can be absorbed using the relative movement. Accordingly, it is possible to prevent the guide frame 20 from deforming by being bent.

According to the embodiment, in the pair of transporting rollers 14 which is formed by the feeding roller 14*a* and the driven roller 14*b*, tensile forces of the plurality of (six) tension coil springs 41 which urge the driven roller 14*b* may be differentiated. That is, the magnitude of the rotating force FM which works in the guide frame 20 may be differentiated in the moving direction X of the carriage 17. For example, in the tension coil spring 41 of which one end is locked to the locking portion 24 which is provided at a position which is close to a so-called print waiting position at which the carriage 17 is located at the time other than printing, a tensile force FH thereof is set to be larger than others. In this manner, it is possible to cause a large rotating force FM corresponding to the impulsive force FS to work with respect to the carriage 17 which is located at the print waiting position.

According to the embodiment, also in the sub-guide frame 30 which supports the end portion of the carriage 17 on the downstream side in the transporting direction Y, a configuration in which oscillating can be performed, or a movement in a sliding manner can be performed with respect to the base frame 13 may be adopted, similarly to the guide frame 20 according to the embodiment. By doing that, it is possible to relieve the impulsive force FS (acceleration) which is applied to the carriage 17 on both the sides in the transporting direction Y.

According to the embodiment, the liquid ejecting head 18 may be a so-called line head type in which printing on the sheet P is possible even in a state in which the liquid ejecting head 18 is fixed, not a type which is reciprocated by the carriage 17.

According to the embodiment, a supply source of ink as liquid which is ejected from the liquid ejecting head 18 may be a supply source other than the ink cartridge EC which is mounted on the carriage 17. For example, the supply source may be an ink storage body which is provided outside the carriage 17, and inside the outer case 12 of the printer 11, or may be an ink storage body which is provided outside of the outer case 12. Since an ink capacity can be increased when using the ink storage body which is provided outside the carriage 17, compared to a case of using the ink cartridge EC in which there is a limit of the ink capacity because the ink cartridge EC is a type which is mounted on the carriage 17, it is possible to perform printing with respect to more sheets P.

In addition, when ink is supplied to the liquid ejecting head 18 from the outside of the outer case 12, it is necessary to pull around an ink supply tube for supplying ink from the outside of the outer case 12 to the inside thereof. Accordingly, it is preferable that the ink supply tube go through a hole or a notch by providing the hole or notch in the outer case 12. Alternatively, the ink supply tube may be pulled around from the outside of the outer case 12 to the inside thereof using a gap which is formed due to a boss, by putting up the boss, or the like, so that an opening and closing body such as a scanner unit or a cover which is provided in the outer case 12 so as to be open and closed is not completely closed with respect to the outer case 12. In this manner, it is possible to secure a supply of ink to the liquid ejecting head 18 using a flow path of the ink supply tube.

According to the embodiment, a plastic film, cloth, metallic foil, or the like, may be used as a medium instead of the sheet P.

According to the embodiment, the printer 11 may be a multi-function printer including other functions such as an image reading unit, or a FAX unit.

According to the embodiments, the printer 11 may be a liquid ejecting apparatus in which liquid other than ink is ejected or discharged. In addition, as a state of liquid which is ejected from the liquid ejecting apparatus as a minute droplet, a granular shape, a tear shape, or a thread shape leaving a trail is included. In addition, the liquid here may be a material which can be ejected from the liquid ejecting apparatus. For example, the liquid includes a material in a state of liquid phase, materials which flow such as a liquid body having high or low viscosity, sols, gel water, and inorganic solvents, organic solvents, liquids, liquid resin, liquid metal (metallic melt) other than that. In addition, the liquid includes materials in which particles of a functional material which is formed of a solid body such as a pigment or metal particles are melted, diffused, or mixed in a solvent, not only the liquid as a state of the material. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, or the like. As specific examples of the liquid ejecting apparatus, there is a liquid ejecting apparatus which ejects liquid including a material such as an electrode material, or a color material which is used when manufacturing, for example, a liquid crystal display, an electroluminescence (EL) display, a plane emission display, a color filter, or the like, in a form of dispersion, or dissolution. In addition, the liquid ejecting apparatus may be a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. Further, the liquid ejecting apparatus may be a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye (optical lens) which is used in an optical communication element, or the like, onto a substrate. In addition, the liquid ejecting apparatus may be a liquid ejecting apparatus which ejects an etching liquid such as an acid or alkali for etching a substrate or the like.

The entire disclosure of Japanese Patent Application No. 2013-071603, filed Mar. 29, 2013 is expressly incorporated by reference herein.

What is claimed is:

1. A liquid ejecting apparatus comprising:

a moving body provided with a liquid ejecting head which ejects liquid from nozzles;

a guide frame which guides the moving body in a moving direction;

an upper facing member arranged to face an upper surface of the guide frame;

a bottom facing member arranged to face a bottom surface of the guide frame;

an urging member which urges the guide frame toward a side opposite to a gravity direction; and wherein the upper facing member contacts with a part of the upper surface of the guide frame to regulate a displacement of the guide frame in an antigravity direction due to the urging member, and wherein the guide frame can be displaced toward the gravity direction side with a gap between the bottom facing member and at least a portion of the bottom surface of the guide frame.

2. The liquid ejecting apparatus according to claim 1, wherein the guide frame is displaceably supported with respect to the bottom facing member, wherein a fulcrum is formed between the guide frame and the bottom facing member at least when the guide frame is being displaced.

3. The liquid ejecting apparatus according to claim 2, wherein a second upper facing member that is arranged to face a portion of the upper surface of the guide frame and that supports the guide frame in a direction which crosses the moving direction of the moving body is provided in the bottom facing member.

4. The liquid ejecting apparatus according to claim 3, wherein a gap in a vertical direction is provided between the second upper facing member and the guide frame.

5. The liquid ejecting apparatus according to claim 2, further comprising:

a pair of transporting rollers which relatively move a medium with respect to the liquid ejecting head by interposing the medium to which the liquid is ejected therebetween, wherein the urging member generates a pinching force of the medium in the pair of transporting rollers.

6. The liquid ejecting apparatus according to claim 1, wherein the guide frame is supported so as to be moved in a sliding manner toward the gravity direction side with respect to the bottom facing member, in the upper facing member.

7. The liquid ejecting apparatus according to claim 1, wherein, at least one of a plurality of the upper facing members which are provided in the moving direction of the moving body allows that the guide frame can relatively move with respect to the bottom facing member along the moving direction of the moving body.

8. A liquid ejecting apparatus comprising:

a supported frame to support a liquid ejecting head which ejects liquid from nozzles;

an upper facing member positioned to face an upper surface of the supported frame;

a bottom facing member positioned to face a bottom surface of the supported frame;

an urging member which urges the supported frame toward a side opposite to a gravity direction; and wherein the upper facing member contacts with a part of the upper surface of the supported frame to regulate a displacement of the supported frame in an antigravity direction due to the urging member, and wherein the guide frame can be displaced towards the gravity direction side with a gap between the bottom facing member and at least a portion of the bottom surface of the supported frame.

9. The liquid ejecting apparatus of claim 8, wherein the liquid ejecting head comprises a line head that is fixed.

10. The liquid ejecting apparatus of claim 8, wherein the liquid ejecting head is movably disposed on the supported frame.

* * * * *